United States Patent [19]

Newell

[11] Patent Number: 4,676,134

[45] Date of Patent: Jun. 30, 1987

[54] ELECTRONIC STRING INSTRUMENT WITH BEND DETECTOR

[75] Inventor: Harold R. Newell, South Newbury, N.H.

[73] Assignee: Mesur-Matic Electronics, Salem, Mass.

[21] Appl. No.: 862,736

[22] Filed: May 13, 1986

[51] Int. Cl.[4] ..... G10H 1/02; G10H 1/12; G10H 1/46; G10H 3/18

[52] U.S. Cl. ..... 84/1.08; 84/1.09; 84/1.11; 84/1.15; 84/1.16; 84/1.24; 84/1.27

[58] Field of Search ..... 84/1.04, 1.06–1.16, 84/1.19, 1.24–1.27, DIG. 9

[56] References Cited

U.S. PATENT DOCUMENTS 4,078,467 3/1978 Kawachi ..... 84/1.27

4,182,213 1/1980 Iodice ..... 84/1.15

4,580,479 4/1986 Bonanno ..... 84/1.16 X

*Primary Examiner*—Stanley J. Witkowski

*Attorney, Agent, or Firm*—Pollock, Vande Sande & Priddy

[57] ABSTRACT

An electronic musical instrument of the stringed type wherein bending of a string results in a change in a parameter of the sound produced. At the bridge of the instrument, each string is connected with a leaf spring which is moved towards the nut end of the instrument when the string is bent. Each leaf spring is connected with a Hall effect device, and the spacing between it and a permanent magnet is changed when the spring moves, thus causing a variation in the output of the Hall effect device, which variation alters a parameter of the audio output produced by a tone generator means.

8 Claims, 5 Drawing Figures

ELECTRONIC STRING INSTRUMENT WITH BEND DETECTOR

The present invention is directed to an electronic musical instrument of the stringed type, and particularly to a feature of the instrument which causes bending of a string to result in a change in a parameter of the sound produced. For example, string bending may result in an increase in pitch, similar to the effect produced in an acoustic or electric guitar, when a string is bent.

It is desirable for an electronic instrument to be able to be played in the same manner as an acoustic instrument and to respond to the performer in similar way. It is also desired for an electronic instrument to produce sound and musical effects which as nearly as possible simulate those which are produced by an acoustic instrument.

One such musical effect provided by an acoustic or electric guitar is that when a string is displaced sideways or "bent" and pressed against the baseboard a sound of somewhat higher pitch is produced then when the string is not bent. The reason for this is that when the string is bent, the tension on it increases, which results in higher pitch.

U.S. Pat. No. 4,306,480 to Eventoff et al. discloses an electronic string instrument which produces sound of higher pitch when the string being played is bent. In one embodiment disclosed by Eventoff et al. the end of the string is wrapped around the shaft of a potentiometer, and according to the patentee, when the string is bent, the shaft is turned, thus varying the resistance of the potentiometer. In another embodiment, bending the string exerts a strain on a suitably mounted piezoelectric crystal.

It is considered that the potentiometer arrangement is not practical because a string when bent normally provides only about 0.01 inch of shortening, far too little motion to operate a potentiometer. Further, potentiometers and associated shafts may be mechanically awkward to incorporate on the sounding box of a guitar, in addition to which there may not be enough room to accommodate a potentiometer associated with each string with a normal spacing between strings.

Piezoelectric crystals are in general relatively expensive and their stability is in question. That is, they may not be stable enough to result in a predictable change in audio output with string bending.

It is therefore an object of the invention to provide an arrangement which results in a predictable change in parameter of the sound with string bending.

It is a further object of the invention to provide an arrangement which is mechanically compact and which provides stable operation over time.

It is a further object of the invention to provide an apparatus which is reasonable in cost.

The above objects are accomplished by utilizing Hall effect devices to generate control signals for the tone generators which correspond to the respective strings. Each Hall effect device is disposed in spaced relation to a permanent magnet and is attached to a spring means located at the bridge of the instrument and arranged to be displaced towards the nut end of the instrument when the string is bent. This causes the spacing between the Hall effect device and the magnet to change, and causes a variation in the output voltage of the Hall effect device. The change in output voltage causes the tone generator means to produce an output tone having an altered parameter, such as a changed pitch, timbre, or loudness.

The invention will be better understood by referring to the accompanying drawing in which.

Figure 1:
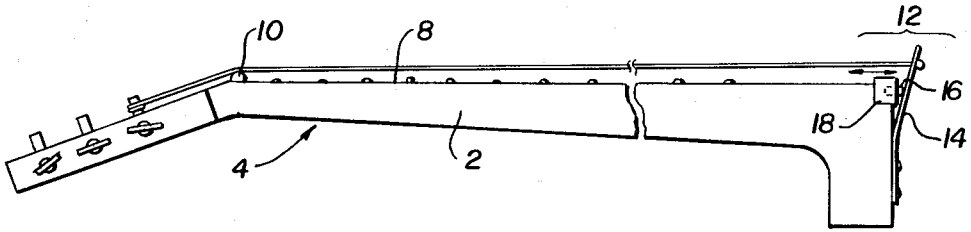
FIG. 1 is a diagrammatic illustration of an embodiment of the invention.

Referring to FIG. 1, the neck 2 of an electronic string instrument 4 such as a guitar is shown. While such an instrument typically has five or six strings, for purposes of illustration only a single string 6 overlying fingerboard 8 is shown, and string 6 is stretched between nut 10 and bridge 12 of the instrument. The instrument also has a body (not shown), which extends from the neck, and which may house electronic components, and have various switches and controls mounted thereon.

The pitch of the sound generated when string 6 is played is dependent on the position on the fingerboard 8 where the string is pressed, the shorter the effective string length from bridge to position of being pressed, the higher the pitch.

For example, the strings may be made of resistive wire, and the point at which they contact a conductive fingerboard will determine the effective resistance in a circuit for generating a voltage corresponding in magnitude to the effective resistance, which voltage may control the output of a voltage controlled audio oscillator for generating tones which will vary in pitch. Such an instrument is generally described in Japanese Laid Open Appl. No. 32708/78, published Mar. 28, 1978, which is incorporated herein by reference.

As discussed above, in an acoustic guitar, when a string is displaced sideways or bent, due to the additional tensioning, the pitch of the sound generated when the string is strummed or picked is somewhat higher in pitch then in the absence of such bending.

As shown in FIG. 1, this same effect is obtained in an electronic instrument with the present invention by mechanically connecting a leaf spring 14 with string 6, which leaf spring is pulled towards the nut end of the instrument when the string is bent. A Hall effect device 16 is attached to the leaf spring and when it moves, the spacing between it and permanent magnet 18 is reduced, thus altering the output voltage produced by the Hall effect device. This output voltage is fed to a voltage control input of the audio oscillator to change the pitch of the audio output, or in the alternative is fed to another circuit of the tone generator means to raise or lower some other parameter of the audio output, such as timbre or loudness.

Figure 2:
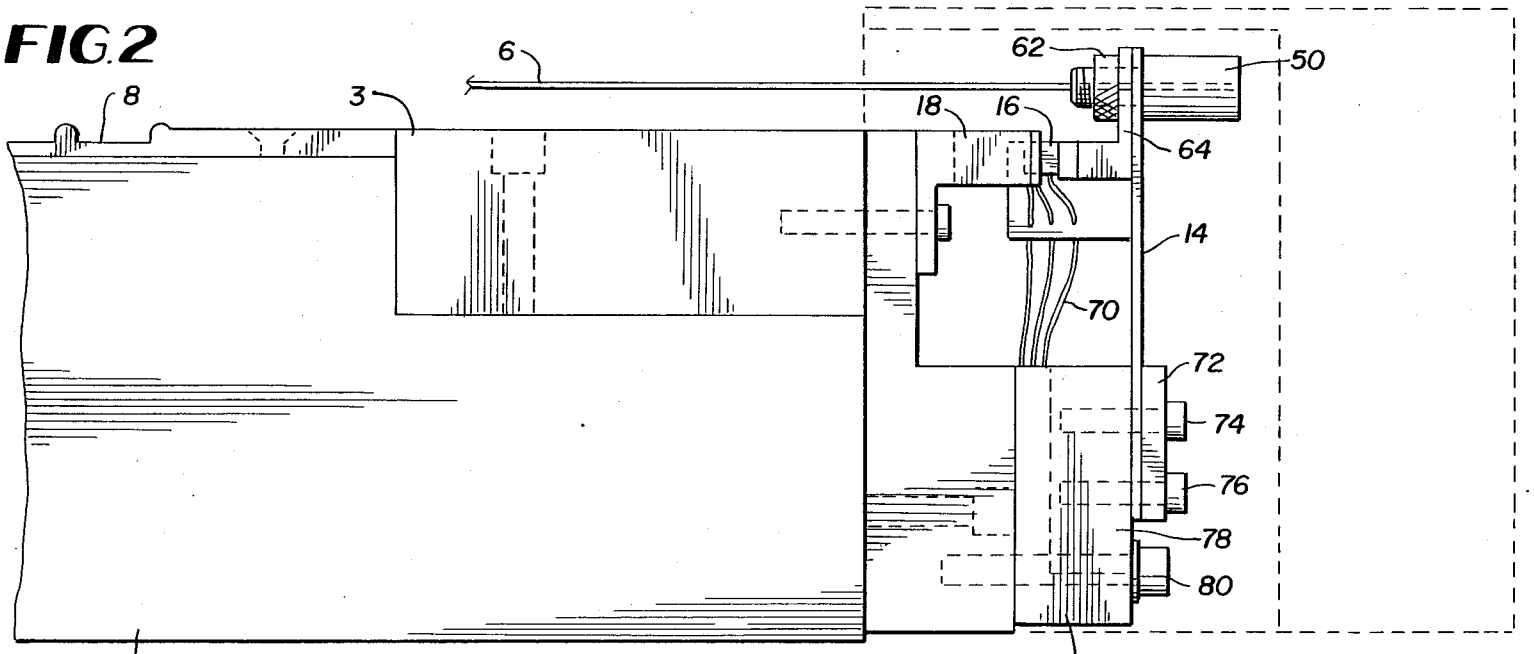
FIG. 2 is a side view in detail of the bridge assembly of an embodiment of the invention.

Referring to FIG. 2, which is a detailed side view of an embodiment of the invention, guitar neck 2 is depicted having a string 6 which overlies fingerboard 8.

String 6 is terminated in string mounting ferrule 50, and leaf spring 14 and Hall effect device mounting means 64 are secured between the ferrule and nut 62.

The leaf spring 14 is secured at its lower end to spring mounting means 73 by spring backing plate 72 and fastening means 74 and 76, while spring mounting means 73 is secured to the guitar neck by fastening means 80.

Figure 4:
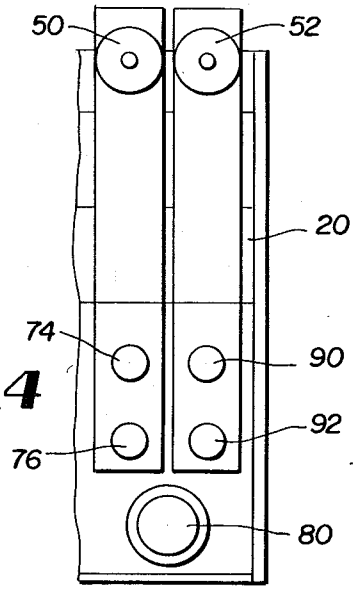
FIG. 4 is an end view of the bridge assembly of an embodiment of the invention.

FIG. 4 is an end view which depicts leaf springs 14 and 20 which are secured between ferrules 50 and 52 respectively and the mounting means at the lower end of the springs.

Figure 3:
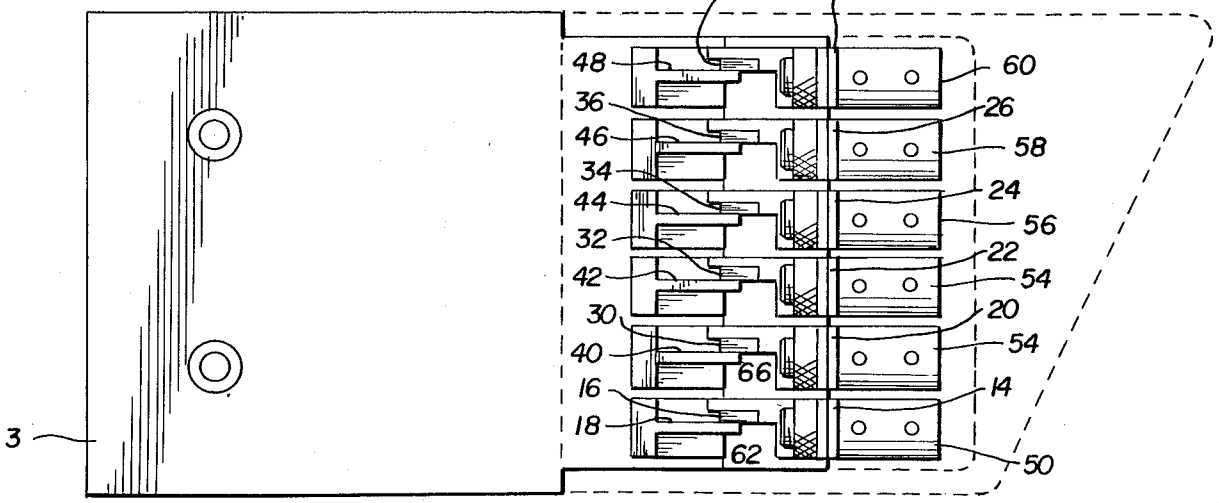
FIG. 3 is a top view in detail of the bridge assembly of an embodiment of the invention.

Referring to FIG. 2, and FIG. 3 which is a detailed top view, permanent magnets 18, 40, 42, 44, 46, and 48 are shown, as well as Hall effect devices 16, 30, 32, 34, 36, and 38, which correspond to the six strings of the instrument. Each of the Hall effect devices is mounted in the L-shaped portion of the respective Hall effect mounting means, such as portion 66 in mounting means 64. In the preferred embodiment, the permanent magnets used are made of samarium cobalt.

When a string is displaced sideways, it becomes tensioned, and thereby pulls the leaf spring to which it is connected towards the nut end of the instrument. This has the effect of moving the Hall effect device further into the permanent magnet, which changes the voltage generated by the Hall effect device. This voltage is outputed by leads 70 shown in FIG. 2.

Figure 5:
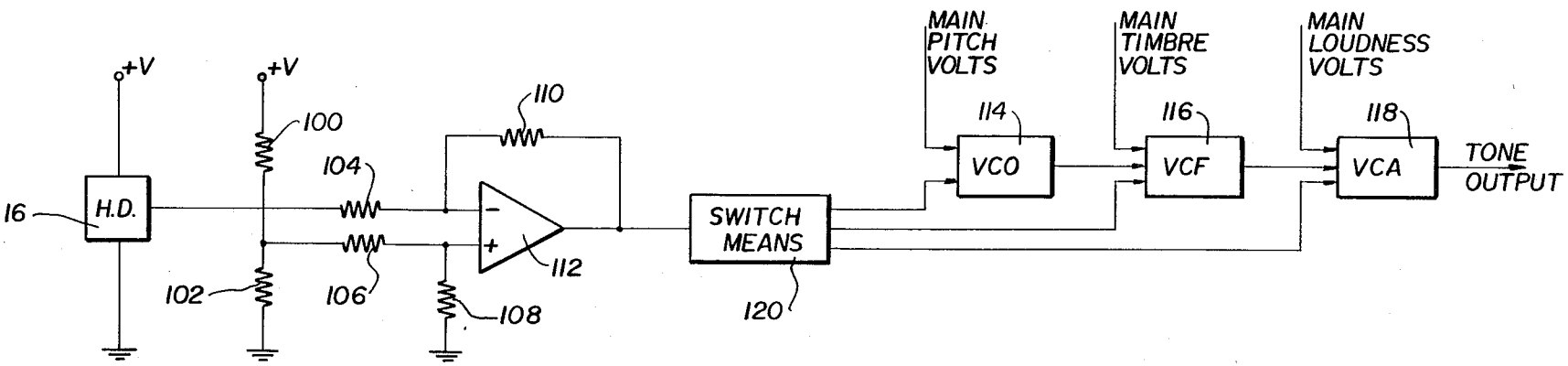
FIG. 5 is a diagram of a circuit for controlling the input voltage the tone generator means.

FIG. 5 shows circuitry for controlling a parameter of the audio output produced by the tone generator with the Hall effect device signal. In this figure, Hall effect device 14 outputs a voltage which is variable with the spacing between itself and the corresponding permanent magnet. The output voltage of the transducer in the absence of a magnetic field is nominally ½ the supply voltage. This voltage is quite stable and has proved sufficiently so for use in a working guitar.

The voltage divider consisting of resistors 100 and 102 serve to provide a voltage which balances out the initial voltage from the Hall effect device 14. This voltage is fed to operational amplifer 112 along with the output of the Hall effect device 14 through resistor 104. Resistors 104, 106, 108 and 110 serve to normalize the signal to ground suitable for use in controlling the tone generator.

The tone generator means or tone synthesizer as it may be called is well known to those skilled in the art, and may typically include a voltage controlled oscillator, a voltage controlled filter, and a voltage controlled amplifier, which are represented by the reference numerals 114, 116, and 118 in FIG. 5. The oscillator controls the pitch of the audio output, while the filter controls the timbre or overtone content, and the amplifier controls the loudness.

In FIG. 5, the output of differential amplifier 112 is fed to switch means 120, which may be a manual or electronic switch, and which is arranged to feed a control signal to one or more (any selected combination) of blocks 114, 116, and 118. Main control voltages are fed to blocks 114, 116, and 118 as shown, and thus the signal provided by string bending may be used to vary the output of one or more of the oscillator, filter, or amplifier. Additionally, the circuitry may be arranged so that the control signal either raises or lowers the pitch, timbre, or loudness, by an amount corresponding to the degree of string bending.

Thus, an electronic musical instrument has been described wherein bending of a string produces a change in a parameter of the audio output, which may in some cases be similar to effects provided by an acoustic string instrument. It should be appreciated that the invention can be used to change any controllable parameter of the synthesizer output with string bending.

Further, the apparatus of the invention provides a predictable and reliable change in sound which corresponds to the degree of string bending. The Hall effect devices utilized have been found to provide stable operation over time.

In an actual embodiment of the invention which was built, the Hall effect device used was the Sprague UGN-3503U.

While an illustrative embodiment of the invention has been disclosed, it should be understood that variations will occur to those skilled in the art, and the invention is defined only by the claims appended hereto and equivalents.

I claim:

1. An electronic musical instrument of the stringed type, wherein sounds are produced by the performer by interacting with the strings of the instrument, and wherein bending of a string causes an alteration of a parameter of the sound produced, comprising, an instrument having a plurality of strings, tone generator means responsive to said performer-string interaction for producing an audio output, a Hall effect device, which outputs an electrical signal, a permanent magnet disposed in spaced relation to the Hall effect device, means responsive to the bending of a string for causing an alteration in the spacing between said Hall effect device and said permanent magnet for causing a variation in the electrical signal outputted by the Hall effect device, and means responsive to said variation in electrical signal for causing a change in a parameter of said audio output which is produced by said tone generator means.

2. The instrument of claim 1 wherein said tone generator means includes an audio oscillator and wherein the parameter of said audio output which is changed by the bending of the string is pitch.

3. The instrument of claim 1 wherein said tone generator means includes a filter and wherein the parameter of said audio output which is changed by the bending of the string is timbre.

4. The instrument of claim 1 wherein said tone generator means includes an amplifier and wherein the parameter of the audio output which is changed by the bending of a string is loudness.

5. The instrument of claim 1 wherein the strings are disposed between a nut end of the instrument and a bridge, and wherein said means responsive to the bending of a string for causing an alteration in the spacing between said Hall effect device and said magnet includes spring means located near said bridge and arranged to be moved towards the nut end of the instrument when said string is bent.

6. The instrument of claim 5 wherein said Hall effect device is attached to said spring means.

7. The instrument of claim 6 wherein said spring means comprises a leaf spring.

8. The instrument of claim 1 wherein the electrical signal outputted by said Hall effect device is a voltage which is fed to one input of a differential amplifier, said voltage having an initial voltage value when the string is unbent and further including supply means for generating a balancing voltage having a value equal to said initial voltage value, which balancing voltage is fed to the other input of said differential amplifier, and wherein the output of said differential amplifier is fed to a voltage control input of said tone generator means.

* * * * *